US005700004A

United States Patent [19]

Bahr et al.

[11] Patent Number: 5,700,004

[45] Date of Patent: Dec. 23, 1997

[54] APPARATUS FOR HANDLING ARTICLES

[75] Inventors: Mel J. Bahr, Corcoran; Timothy A. Bahr, Brooklyn Park, both of Minn.

[73] Assignee: MGS Machine Corporation, Maple Grove, Minn.

[21] Appl. No.: 611,801

[22] Filed: Mar. 6, 1996

[51] Int. Cl.[6] ..... B65H 1/02

[52] U.S. Cl. ..... 271/171; 271/104; 271/149; 221/242; 414/900

[58] Field of Search ..... 414/798.9, 900; 271/97, 98, 104, 171, 149; 221/242, 241; 493/122, 315

[56] References Cited

U.S. PATENT DOCUMENTS

| | | | |
|---|---|---|---|
| 3,083,013 | 3/1963 | Morrison et al. | 414/900 |
| 3,407,965 | 10/1968 | Kuhlman . | |
| 3,527,367 | 9/1970 | Bivans | 414/798.9 |
| 3,947,017 | 3/1976 | Seragnoli . | |
| 4,108,321 | 8/1978 | Lowery | 414/798.9 |
| 4,109,803 | 8/1978 | Quelch . | |
| 4,194,442 | 3/1980 | Martelli . | |
| 4,350,466 | 9/1982 | Bahr et al. . | |
| 4,564,188 | 1/1986 | McNair | 414/798.9 |
| 4,575,298 | 3/1986 | Maas et al. . | |
| 4,674,935 | 6/1987 | Feliks et al. . | |
| 4,690,395 | 9/1987 | Nowicki | 271/98 |
| 5,078,669 | 1/1992 | Dietrich et al. | 493/315 |
| 5,131,899 | 7/1992 | Nagahashi et al. . | |
| 5,503,519 | 4/1996 | Schwetz et al. | 414/798.9 |

*Primary Examiner*—Karen B. Merritt
*Assistant Examiner*—Douglas Hess
*Attorney, Agent, or Firm*—Merchant, Gould, Smith, Edell, Welter & Schmidt, P.A.

[57] ABSTRACT

The present invention relates to a hold-back device for use with a magazine of an article-handling apparatus. The hold-back device includes a frame defining a feed gap through which articles from the magazine are fed. A plurality of threaded members are threadingly mounted in threaded openings defined by the frame. The threaded members have distal ends adapted to extend into the feed gap to hold back the articles held by the magazine. By threading the threaded members in or out of the frame, the distal ends of the threaded members can be set to desired positions in the feed gap.

13 Claims, 3 Drawing Sheets

APPARATUS FOR HANDLING ARTICLES

FIELD OF THE INVENTION

The present invention relates generally to article-handling apparatuses. More particularly, the present invention relates to article-handling apparatuses used to remove stacked articles from a magazine and individually advance the articles to a subsequent station.

BACKGROUND OF THE INVENTION

Various types of devices for feeding and handling articles are known in the prior art. Such devices have been used, for example, in the printing industry to individually remove sheets of paper from a stack of paper held in a tray or magazine. The sheets of paper are typically moved from the magazine to a second location such as a conveyor that moves a sheet into a press or other machine. Such devices have also been used in the container-manufacturing industry to denest plastic trays or to pick coupons or premiums from a stack and advance them to a moving conveyor for placement thereon or insertion within a container therein. It will be appreciated that a wide variety of articles are picked and placed by such article-handling apparatuses. Exemplary articles include paper, coupons, labels, greeting cards, parchment paper, glassine, card stock, envelopes, paper/plastic plates, styrofoam and plastic trays, packets, paper board trays, and flat cartons.

U.S. Pat. No. 4,350,466 discloses an article-handling apparatus for individually removing stacked articles from a magazine. The article-handling apparatus includes a hold-back structure that is non-detachably connected to the mouth of the magazine. The hold-back structure engages the stack of articles held by the magazine in such a manner that only one article is removed from the stack at a time. When a different type of article is to be handled by the article-handling apparatus, the hold-back structure is adjusted in accordance with the dimensions of the new article to be handled. A tool is required to set the hold-back structure to a desired position. Even with the use of a tool, the hold-back structure cannot be precisely adjusted or easily repositioned to a predetermined location. Therefore, adjusting the hold-back structure is a time consuming trial and error process.

In order to provide quick and accurate adjustments to article-handling apparatuses, manufacturers often change the entire magazine structure. Typically, the manufacturer has different magazines having preset hold-back structure adjusted to correspond to a particular product. When a new product is to be handled by the article-handling apparatus, the old magazine is removed from the machine and is replaced with a magazine that corresponds to the new product. A significant problem with such a solution is that having multiple magazines is expensive.

What is needed is an improved hold-back device for holding back articles that are held by the magazine of an article-handling apparatus to enable the article-handling apparatus to individually remove the articles from the magazine. What is also needed is a hold-back device that can be easily adjusted without requiring a tool. What is further needed is a hold-back device that can be finely adjusted and easily repositioned to a desired predetermined position.

SUMMARY OF THE INVENTION

The present invention relates to a hold-back device for use with a magazine of an article-handling apparatus. The hold-back device includes a frame having opposing first and second frame members together defining a feed gap therein between. The first frame member includes a first surface facing the feed gap and a second surface facing away from the feed gap. The first frame member also defines a first threaded opening extending generally transversely therethrough from the first to the second surface. The hold-back device also includes mounting structure adapted to mount the frame on the article-handling apparatus such that articles held by the magazine can be fed through the feed gap of the frame. The hold-back device further includes a first threaded member threadingly mounted in the first threaded opening of the first frame member. The first threaded member includes a distal end adapted to extend from the first surface into the feed gap. The first threaded member is rotatable within the first threaded opening such that the distal end of the first threaded member can be adjusted to a desired position so as to hold back the articles that are held by the magazine.

Alternative embodiments of the present invention relate to hold-back devices having multiple threaded members threadingly engaging a frame and functioning to hold back articles that are held by the magazine of an article-handling apparatus. Other embodiments of the present invention relate to hold-back devices having opposing threaded members that threadingly engage a frame and cooperate to hold back articles that are held by the magazine of a article-handling apparatus. Other embodiments of the present invention relate to hold-back devices including leaf spring members cooperating with threaded members to hold-back articles that are held by the magazine of an article-handling apparatus. Further embodiments of the present invention relate to hold-back devices that are detachably mounted on the mouth of the magazine of an article handling apparatus. Additional hold-back devices constructed in accordance with the principles of the present invention incorporate air nozzles that are adapted to direct pressurized air between articles held by a magazine so as to facilitate denesting the articles.

A variety of additional advantages of the invention will be set forth in part in the description which follows, and in part will be obvious from the description, or may be learned by practice of the invention. The advantages of the invention will be realized and attained by means of the elements and combinations particularly pointed out in the claims. It is to be understood that both the foregoing general description and the following detailed description are exemplary and explanatory only and are not restrictive of the invention as claimed.

BRIEF DESCRIPTION OF THE DRAWINGS

The accompanying drawings, which are incorporated in and constitute a part of this specification, illustrate several embodiments of the invention and together with the description, serve to explain the principles of the invention. A brief description of the drawings is as follows.

DETAILED DESCRIPTION OF THE INVENTION

Reference will now be made in detail to exemplary embodiments of the present invention which are illustrated in the accompanying drawings. Wherever possible, the same reference numbers will be used throughout the drawings to refer to the same or like parts.

Figure 1:
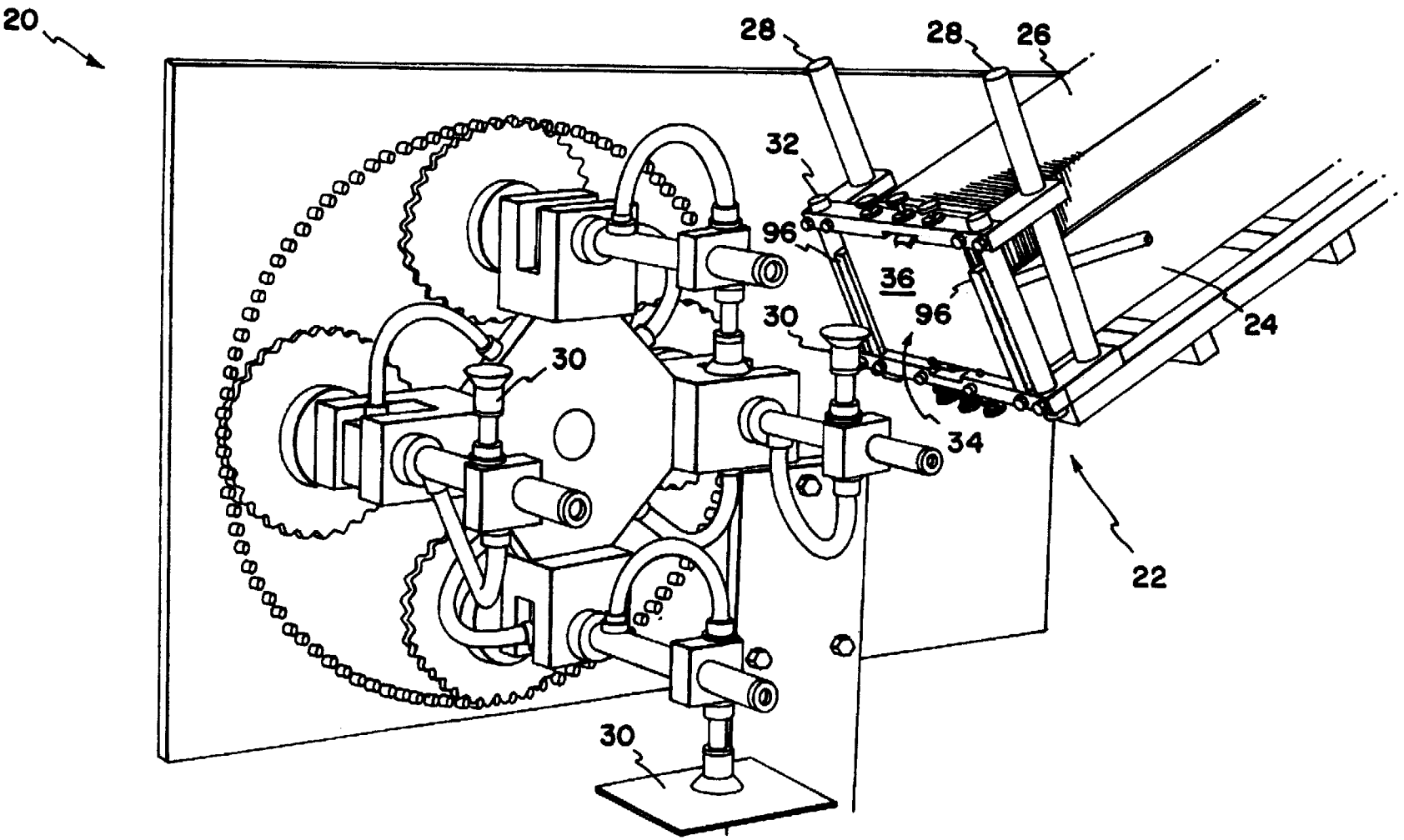
FIG. 1 is a perspective view of an article-handling apparatus incorporating a hold-back device constructed in accordance with the principles of the present invention.

FIG. 1 shows an exemplary article-handling apparatus 20 that is used in association with a hold-back device 22 constructed in accordance with the principles of the present invention. The article-handling apparatus 20 includes a magazine 24 or tray configured to hold a stack 26 of articles. The article-handling apparatus 20 also includes a pair of mounting posts 28 located adjacent to a mouth of the magazine 24. The article-handling apparatus 20 further includes suction cup mechanisms 30 adapted to individually remove front-most articles 36 from the mouth of the magazine 24. For a more detailed description of the article-handling apparatus 20, reference should be made to U.S. Pat. No. 4,350,466 which is incorporated by reference.

The hold-back device 22 is preferably mounted on the mounting post 28 adjacent to the mouth of the magazine 24. In general terms, the hold-back device 22 includes a frame 32 defining a feed gap 34. The hold-back device 22 also includes structure for holding back the stack 26 of articles such that the articles can be individually removed from the mouth of the magazine 24 by the article handling apparatus 20.

In general operation, the suction cups 30 of the article-handling apparatus 20 individually remove articles from the mouth of the magazine 24 by forming a vacuum assisted engagement with the front-most articles 36 of the stack 26 and picking the front-most articles 36 from the mouth of the magazine 24. As the front-most articles 36 are removed from the mouth of the magazine 24, the hold-back structure of the hold-back device 22 engages the top and bottom edges of the subsequent articles in the stack 26 thereby holding back the remainder of the articles in the stack 26 such that only one article is removed from the mouth of the magazine 24 at a time.

Figure 2:
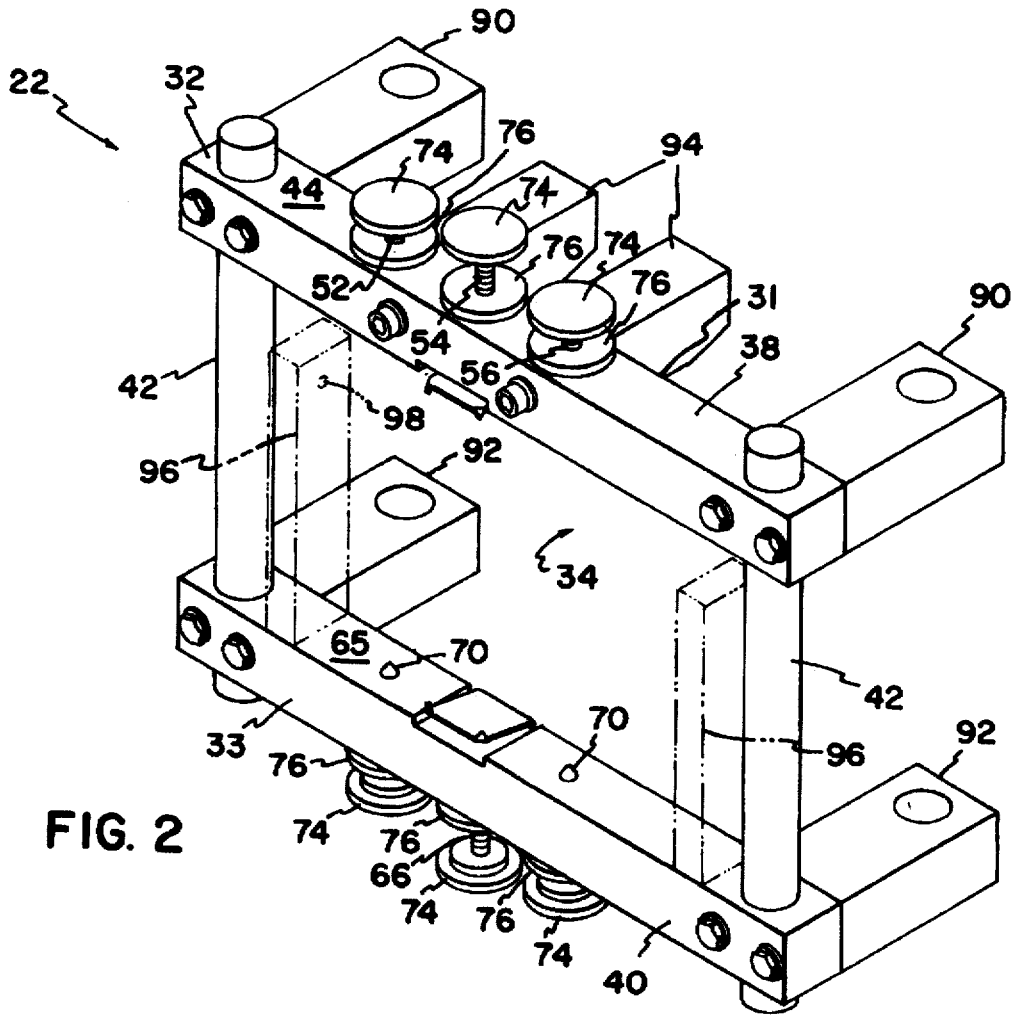
FIG. 2 is an enlarged perspective view of the hold-back device of FIG. 1 shown separate from the article-handling apparatus of FIG. 1.

FIG. 2 shows an enlarged perspective view of the hold-back device 22 in isolation from the article handling apparatus 20. As shown in FIG. 2, the frame 32 of the hold-back device 22 includes a top frame member 38 that opposes and is generally parallel to a bottom frame member 40. The top and bottom frame members 38 and 40 have ends that are preferably connected to each other by a pair of opposing side members 42. The opposing side members 42 preferably extend generally transversely between the ends of the top and bottom frame members 38 and 40 such that the frame 32 has a generally rectangular shape. The top and bottom frame members 38 and 40 and the side members 42 cooperate to define the feed gap 34 of the frame 32. Articles from the stack 26 are fed through the feed gap 34 from a back side 31 of the frame 32 to the front side 33 of the frame 32.

The top frame member 38 is shown defining first, second and third internally threaded openings 48, 49 and 50. The first, second and third internally threaded openings 48, 49 and 50 preferably extend generally transversely through the top frame member 38 between an outer surface 44 facing away from the feed gap 34 and an inner surface 46 facing toward the feed gap 34. Similarly, the bottom frame member 40 is shown having fourth, fifth and sixth internally threaded openings 58, 60 and 62 that are respectively co-axially aligned with the first, second and third internally threaded openings 48, 49 and 50 of the top frame member 38. The fourth, fifth and sixth threaded openings 58, 60 and 62 are shown extending generally transversely through the bottom frame member 40 between an outer surface 63 facing away from the feed gap 34 and an inner surface 65 facing toward the feed gap 34.

Respectively mounted in the threaded openings 48, 49, 50, 58, 60, and 62 are first, second, third, fourth, fifth, and sixth threaded members 52, 54, 56, 64, 66, and 68. The threaded members 52, 54, 56, 64, 66, and 68 have external radial threads that mate with the internal thread of the threaded openings 48, 49, 50, 58, 60, and 62. Consequently, by rotating the threaded members 52, 54, 56, 64, 66, and 68 in a first direction, such as clockwise, the threaded members 52, 54, 56, 64, 66, and 68 can be threaded into the threaded openings 48, 49, 50, 58, 60, and 62. In contrast, by rotating the threaded members 52, 54, 56, 64, 66, and 68 in a second direction, such as counter clockwise, the threaded members 52, 54, 56, 64, 66, and 68 can be threaded out of the threaded opening 48, 49, 50, 58, 60, and 62.

Drive knobs 74 are preferably fixedly connected to each of the threaded members 52, 54, 56, 64, 66, and 68 at proximal ends located generally adjacent to one of the outer surfaces 46 and 63 of the frame 32. The drive knobs 74 are adapted to be manually gripped and twisted to rotate the threaded members 52, 54, 56, 64, 66, and 68 within the threaded openings 48, 49, 50, 58, 60, and 62. The enlarged gripping diameters provided by the drive knobs 74 allow a user to manually generate sufficient torque to easily thread the threaded members 52, 54, 56, 64, 66, and 68 in and out of the threaded openings 48, 49, 50, 58, 60, and 62.

Locking knobs 76 are threadingly mounted on each of the threaded members 52, 54, 56, 64, 66, and 68. The locking knobs 76 are preferably positioned between the drive knobs 74 and one of the outer surfaces 44 and 63 of the frame 32. The threaded engagement between the locking knobs 76 and the threaded member 52, 54, 56, 64, 66, and 68 causes the locking knobs 76 to move axially along the threaded members 52, 54, 56, 64, 66, and 68 when rotated. By threading the locking knobs 76 against the outer surfaces 44 and 63, the locking knobs 76 are caused to frictionally engage the outer surfaces 44 and 63 such that the threaded members 52, 54, 56, 64, 66, and 68 are locked in a desired position.

Figure 3:
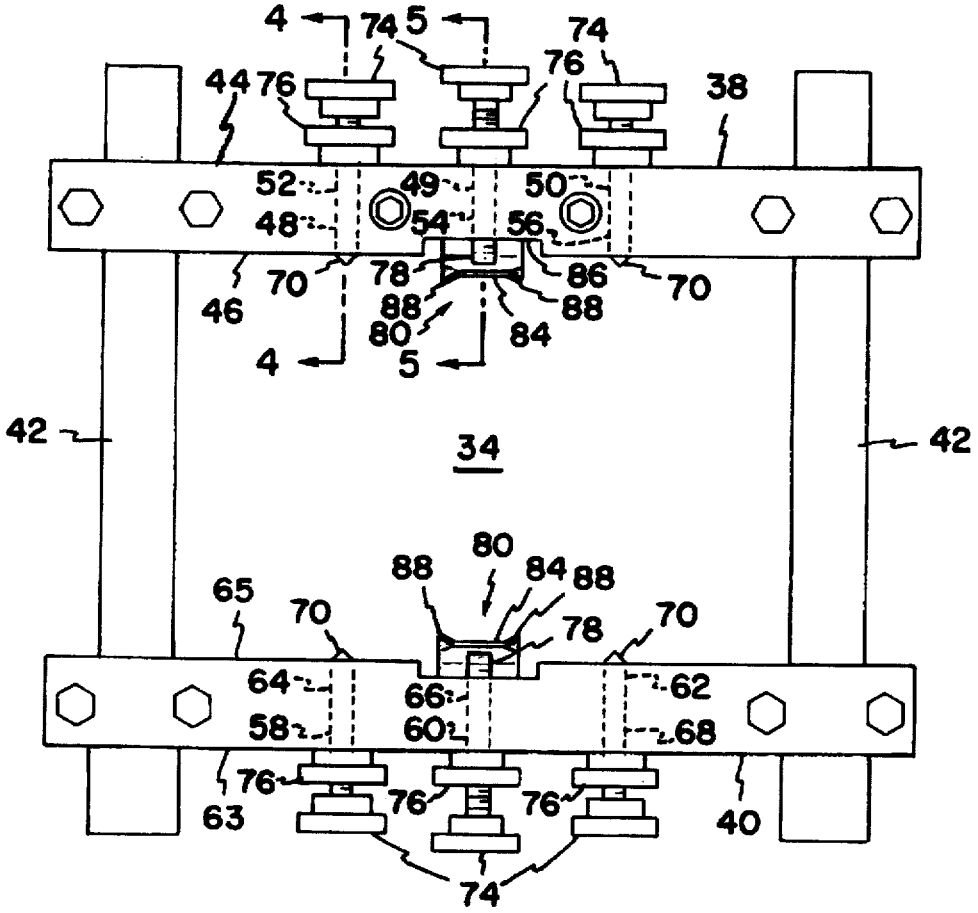
FIG. 3 is a front view of the hold-back device of FIG. 2.

FIGS. 2 and 3 show the second threaded member 54 located directly between the first and third threaded members 52 and 56 and the fifth threaded member 66 located directly between the fourth and sixth threaded members 64 and 68. The first, third, fourth, and sixth threaded members 52, 56, 64, and 68 preferably have pointed distal ends 70 adapted to extend from the inner surfaces 46 and 65 of the frame 32 into the feed gap 34. By rotating the threaded members 52, 56, 64, and 68, the pointed distal ends 70 can be moved to desired positions within the feed gap 34.

Figure 4:
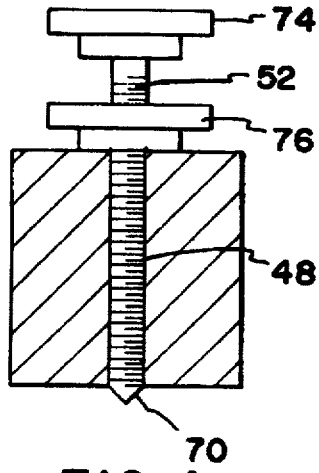
FIG. 4 is a cross-sectional view of the hold-back device of FIG. 3 taken along section line 4—4.

FIG. 4 shows a cross-sectional view of the first threaded member 52. It will be appreciated that the cross-sectional view of FIG. 4 is also representative of the third, fourth and sixth threaded members 56, 64 and 68.

Figure 5:
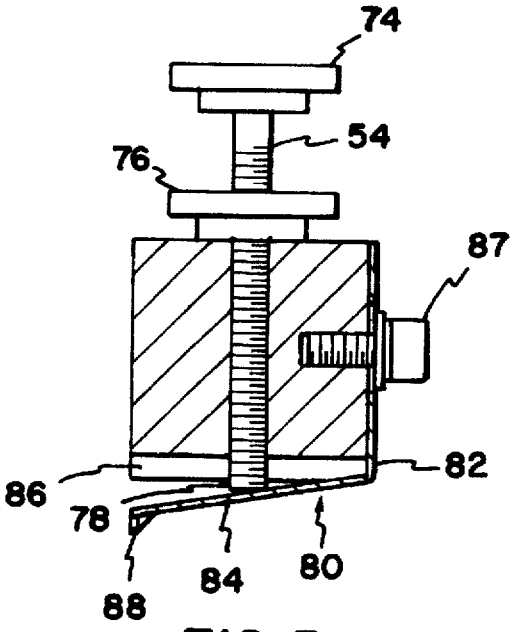
FIG. 5 is a cross-sectional view of the hold-back device of FIG. 3 taken along section line 5—5.

The second and third threaded members 54 and 66 shown in FIG. 5 preferably have substantially flat distal ends 78 that cooperate with leaf spring members 80. The leaf spring members 80 preferably include base ends 82 connected to the frame members 38 and 40 and free ends 84 biased against the distal ends 78 of the second and fifth threaded members 54 and 66. The inner surfaces 46 and 65 of the frame 32 preferably define rectangular slots 86 for providing clearance to allow the leaf spring members 80 to flex with respect to the frame members 38 and 40. The free ends 84 of the leaf spring members 80 extend from the inner surfaces 46 and 65 of the frame 32 into the feed gap 34 and are adapted for engaging the stacked articles 26 held by the magazine 24. Additionally, the free ends 84 of the leaf spring members 80 include corners 88 that are bent toward the feed gap 34 so as to enhance the leaf spring members 80 ability to hold back the stacked articles 26. The bent corners 88 of the leaf spring members 80 are preferably positioned closer to the front side 33 of the frame 32 than the pointed distal ends 70 of the first, third, fourth and sixth threaded members 52, 56, 64 and 68.

The base ends 82 of the leaf spring members 80 are preferably connected to the frame members 38 and 40 by conventional connecting techniques such as a bolt 87. FIG. 5 shows a cross-sectional view of the second threaded member 54 in cooperation with its corresponding leaf spring member 80. It will be appreciated that FIG. 5 is representative of the fifth threaded members 66 and its corresponding leaf spring member 80.

Referring again to FIGS. 2 and 3, the pointed distal ends 70 of the first and third threaded members 52 and 56 oppose the pointed distal ends 70 of the fourth and sixth threaded members 58 and 62. Similarly, the leaf spring member 80 associated with the top frame member 38 opposes the leaf spring member 80 associated with the bottom frame member 40. The leaf spring members 80 and the pointed distal ends 70 cooperate to engage the top and bottom edges of articles that are fed through the feed gap 34. By rotating the threaded members 52, 54, 56, 64, 66 and 68, the pointed distal ends 70 and the free ends 84 of the leaf springs 80 can be moved to predetermined locations corresponding to the top and bottom edges of differently sized articles.

The hold-back device 22 also preferably includes mounting structure adapted for detachably mounting the hold-back device 22 on the article handling apparatus 20. For example, in the embodiment of FIG. 2, the hold-back device 22 is shown including an upper pair of mounting brackets 90 connected to the top frame member 38 and a lower pair of mounting brackets 92 connected to the bottom frame member 40. The top and bottom mounting brackets 90 and 92 define co-axially aligned holes that are sized and shaped to slidingly receive the mounting posts 28 of the article-handling apparatus 20. Therefore, the hold-back device 22 can be mounted on the mouth of the magazine 24 by inserting the mounting posts 28 through the co-axially aligned holes.

As shown in FIG. 2, the mounting brackets 90 and 92 extend generally transversely outward from the back of the frame 32. The mounting brackets 90 and 92 are connected to the frame 32 by conventional connecting techniques such as welding or bolts.

The frame 32 also includes a plurality of guide members 94 connected to the top frame member 38. The guide members 94 preferably extend transversely outward from the back of the top frame member 38. The guide members 94 are preferably connected to the back of the frame by conventional connecting techniques such as bolts or welding. The guide members 94 function to guide or push down unevenly stacked articles held by the magazine 24.

The hold-back device 22 may also include a pair of opposing air nozzles 96 connected to the opposite sides 42 of the frame 32. The air nozzles 96 are preferably detachably connected to a source of compressed air by such conventional means as a hose coupling. The nozzles 96 include orifices 98 that face the feed gap 32 of the hold-back device 22. The orifices 98 are positioned between the pointed distal ends 70 of the threaded members 52, 56, 64 and 68 and the bent corners 88 of the leaf springs 80 and are aligned to direct a stream of compressed air transversely into the feed gap 34. The localized air provided by the nozzles 96 functions to denest the stacked articles held by the magazine 24 by blowing the air between consecutive articles. For typical uses, the diameters of the orifices 98 typically range from 1/16 to 1/8 inch and the pressure provided by the source of compressed air ranges from 5 to 30 pounds per square inch. Such air assisted denesting is especially important in denesting articles such as plastic trays that have a tendency to stick together.

In use, the hold-back device 22 is mounted on the mouth of the magazine 24 by inserting the mounting posts 28 through the co-axially aligned holes of the mounting brackets 90 and 92. The pointed distal ends 70 of the threaded members 52, 56, 64, and 68 are then moved to desired positions within the feed gap 34 by threading the threaded members 52, 56, 64 and 68 in or out of the threaded openings 48, 50, 58 and 62. Similarly, the free ends 84 of the leaf spring members 80 are set to desired positions by threading the threaded members 54 and 66 in or out of the threaded openings 49 and 60. The threaded members 52, 54, 56, 64, 66 and 68 are then locked in the desired positions by threading the locking knobs 76 against the outer surfaces 44 and 63 of the frame 32.

Once the threaded members 52, 54, 56, 64, 66 and 68 are locked in place, the article-handling apparatus 20 is actuated causing the suction cups 30 to begin to individually remove the front-most articles 36 from the mouth of the magazine 24. As each front-most article 36 is picked from the mouth of the magazine 24, the remaining articles in the stack 26 move forward toward the mouth of the magazine 24, typically through the force of gravity, so as to fill the space vacated by the removed article. As the articles in the stack 26 move forward, the several articles located nearest to the front of the stack 26 are retained loosely between the opposing leaf springs 80. The front-most articles 36 are held on the magazine 24 by the bent corners 88 of the leaf spring members 88 until they are removed from the magazine 24 by the suction cups 30. The remainder of the stack 26 is held back by the pointed distal ends 70 of the first, third, fourth, and sixth threaded members 52, 56, 64 and 68. To enhance the denesting of articles such as plastic trays, the air nozzles 96 may be used to blow air between the articles held by the leaf springs 80 to separate them from each other.

It will be appreciated that the hold-back device 22 of FIGS. 1–5 is only a preferred arrangement for the present invention which can be varied in a number of ways. For example, different numbers and combinations of threaded members and leaf springs may be employed depending upon the type of stacked article that is being held back. The threaded members could have distal ends with a variety of different configurations. They need not be included in both the top and bottom of the frame, and they may be incorporated in the sides of the frame. The number, positioning and arrangement of the spring and threaded members may also be varied. Other variations can also be made without departing from the principles of the present invention.

With regard to the foregoing description, it is to be understood that changes may be made in detail, especially in matters of the construction materials employed and the shape, size, and arrangement of the parts without departing from the scope of the present invention. It is intended that the specification and depicted embodiment be considered exemplary only, with a true scope and spirit of the invention being indicated by the broad meaning of the following claims.

What is claimed is as follows:

1. A hold-back device for use with a magazine of an article-handling apparatus, the hold-back device comprising:

a frame structure defining a feed gap, the frame structure including a first surface facing the feed gap and a second surface facing away from the feed gap, and the frame structure defining a first threaded opening extending from the first to the second surface;

mounting structure adapted to mount the frame structure on the article-handling apparatus such that articles held by the magazine can be fed through the feed gap of the frame structure;

a first threaded member threadingly mounted in the first threaded opening of the frame structure and including a distal end adapted to extend from the first surface into the feed gap, the first threaded member being rotatable within the first threaded opening such that the distal end of the first threaded member can be adjusted to a desired position so as to hold back the articles that are held by the magazine;

a first knob fixedly connected to a proximal end of the first threaded member for rotating the first threaded member; and a second knob threadingly mounted on the first threaded member between the first knob and the second surface of the frame structure, wherein the second knob is adapted to engage the second surface of the frame structure to retain the first threaded member at the desired position.

2. The hold-back device of claim 1, wherein the distal end of the first threaded member is pointed.

3. The hold-back device of claim 1, further comprising a leaf spring member including a base end connected to the frame structure and a free end portion biased against the distal end of the first threaded member.

4. The hold-back device of claim 3, wherein the free end portion of the leaf spring includes corners that are bent toward the feed gap.

5. The hold-back device of claim 1, wherein the frame structure defines a second threaded opening threadingly receiving a second threaded member generally opposite the first threaded member.

6. The hold-back device of claim 1, further comprising a nozzle connected to the frame structure and adapted to direct pressurized air between the articles held by the magazine.

7. An apparatus for handling articles comprising:

a magazine assembly for holding the articles, the magazine assembly including left and right mounting posts, the mounting posts being located adjacent to a mouth of the magazine assembly and being spaced-apart a first distance;

a feed apparatus for individually removing the articles from the magazine assembly; and a hold-back device adapted to be mounted on the mounting posts of the magazine assembly, the hold-back device including;

a frame structure defining a feed gap through which the articles can be fed when the hold-back device is mounted on the magazine assembly;

at least one hold-back member projecting from the frame structure into the feed gap, the at least one hold-back member being arranged and configured to retain articles at the mouth of the magazine assembly when the hold-back device is mounted on the magazine assembly; and left and right mounting brackets which are connected to the frame structure, the left mounting bracket defining a first pair of co-axially aligned holes that are spaced substantially the first distance from a second pair of co-axially aligned holes defined by the right mounting bracket, the first and second pairs of co-axially aligned holes being substantially the same size as the mounting posts, wherein the hold-back device can be mounted on the magazine assembly without the use of a tool by concurrently sliding the left mounting post through the first pair of co-axially aligned holes, and the right mounting post through the second pair of co-axially aligned holes.

8. The apparatus of claim 7, wherein the at least one hold-back member comprises a threaded member that is threaded within a threaded opening defined by the frame structure.

9. The apparatus of claim 8, wherein the threaded member has a pointed distal tip adapted to project into the feed gap of the frame structure.

10. The apparatus of claim 7, wherein the at least one hold-back member comprises a leaf spring.

11. A hold-back device configured to be mounted at a mouth of a magazine of an article-handling apparatus, the magazine having a hold-back device receiving means, the hold-back device comprising:

a frame structure defining a feed gap;

a hold-back structure projecting from the frame structure into the feed gap, the hold-back structure being adapted for engaging articles that are fed through the feed gap of the frame structure; and mounting structure extending from the frame structure, the mounting structure being constructed and arranged to allow the frame structure to be removed from the magazine without requiring the aid of tools, and the mounting structure including means for slidably engaging the mounting structure with the receiving means of the magazine allowing multiple hold back devices having varying preset hold back structure sizes to be efficiently interchanged at the mouth of the magazine to accommodate articles of varying size.

12. The hold back device of claim 11, further comprising the magazine, wherein one of the means for slidably engaging and the receiving means includes left and right mounting posts, and the other of the means for slidably engaging and the receiving means includes left and right pairs of co-axially aligned holes sized and arranged to slidably receive the left and right mounting posts.

13. The hold back device of claim 11, wherein the hold back structure includes a leaf-spring and also includes first, second, and third threaded members that are threaded within the frame structure, the first and third threaded members having pointed distal ends constructed and arranged to engage the articles that are fed through the feed gap, the leaf-spring being located between the first and third threaded members and being configured for engaging the articles that are fed through the feed gap, and the second threaded member being configured for controlling the positioning of the leaf-spring within the feed gap.

* * * * *